US010219620B2

(12) United States Patent
Chen

(10) Patent No.: US 10,219,620 B2
(45) Date of Patent: Mar. 5, 2019

(54) MIRRORED STORAGE CABINET

(71) Applicant: Guangdong Mirror Light Bathroom Technology Co., LTD, Foshan (CN)

(72) Inventor: Shiping Chen, Foshan (CN)

(73) Assignee: Guangdong Mirror Light Bathroom Technology Co., LTD, Foshan (CN)

( * ) Notice: Subject to any disclaimer, the term of this patent is extended or adjusted under 35 U.S.C. 154(b) by 52 days.

(21) Appl. No.: 15/480,351

(22) Filed: Apr. 5, 2017

(65) Prior Publication Data

US 2017/0303684 A1 Oct. 26, 2017

(30) Foreign Application Priority Data

Apr. 21, 2016 (CN) ..... 2016 2 0349176 U

(51) Int. Cl.
*F21V 33/00* (2006.01)
*A47B 67/00* (2006.01)
*A47B 96/00* (2006.01)

(52) U.S. Cl.
CPC ..... *A47B 67/005* (2013.01); *A47B 96/00* (2013.01); *A47B 2220/0077* (2013.01)

(58) Field of Classification Search
CPC ..... A45D 33/32; A47B 67/005; A47B 2220/0077
See application file for complete search history.

(56) References Cited

U.S. PATENT DOCUMENTS

2014/0334139 A1* 11/2014 Smith ..... F21S 9/02 362/191

* cited by examiner

*Primary Examiner* — Andrew J Coughlin
(74) *Attorney, Agent, or Firm* — Gokalp Bayramoglu

(57) ABSTRACT

A mirrored storage cabinet is disclosed, including: a cabinet body formed by a bottom plate and an upper frame, a lower frame, a left frame and a right frame installed at four sides of the bottom plate; and a cabinet door installed at an opening of the cabinet body, wherein a first separating plate and a second separating plate are provided on the bottom plate close to the left frame and the right frame, side mirrors are provided respectively above the left frame and the first separating plate and above the right frame and the second separating plate, LED light strips are installed below the side mirrors via supports on the bottom plate, a division plate is provided between the first separating plate and the second separating plate, and the cabinet door is movably installed at the side edge of the first separating plate.

9 Claims, 3 Drawing Sheets

MIRRORED STORAGE CABINET

CROSS REFERENCE TO RELATED APPLICATIONS

This application is based upon and claims priority to Chinese Patent Application No, 201620349176.2 filed on Apr. 21, 2016, the entire contents of which are incorporated herein by reference.

Technical. Field

The present application relates to the field of storage cabinets, in particular to a mirrored storage cabinet.

Background

Currently available storage cabinets have various kinds and different structures, and those combined with a mirror typically use a hinge to connect a door and a cabinet body, such that the door can be pivoted relative to the cabinet body. Since the mirror, when used in the bathroom, may be misted by hot air during shower such that the image in the mirror cannot be presented clearly, a heating sheet is typically provided in an interlayer of the door and is attached to the mirror for heating the mirror. The mirror is heated by the heating sheet for quickly defogging. With the improvement of living standards and the changes in aesthetic views, higher demands on the appearance and function of the storage cabinets are made.

SUMMARY OF THE INVENTION

The technical problem to be solved by the embodiments of the present application is providing a mirrored storage cabinet which has a simple structure, air aesthetic appearance and light illumination.

In order to solve the above-mentioned technical problem, the present application provides a mirrored storage cabinet, including: a cabinet body formed by a bottom plate and an upper frame, a lower frame, a left frame and a right frame installed at four sides of the bottom plate; and a cabinet door installed at an opening of the cabinet body. A first separating plate and a second separating plate are provided on the bottom plate close to the left frame and the right frame. Side mirrors are provided respectively above the left frame and the first separating plate and above the right frame and the second separating plate. LED light strips are installed below the side mirrors via supports on the bottom plate. A division plate is provided between the first separating plate and the second separating plate. The cabinet door is movably installed at the side edge of the first separating plate.

Preferably, said cabinet door comprises a front door mirror and a rear door mirror. An aluminium strip, a LED light strip and an anti-fog film are provided between said front door mirror and said rear door mirror.

Preferably, support legs are provided at two edges of the bottom end of said lower frame. A sensory switch is provided at the bottom end of said lower frame. A sensory switch power supply is provided on the bottom plate between said right frame and said second separating plate. Said sensory switch is connected to an external power supply. Said sensory switch is connected to said LED light strips and said anti-fog film via said sensory switch power supply and said hinge.

Preferably, EVA adhesive and decorative strips are provided between said left and right frames and said first and second separating plates on the one hand and said side mirrors on the other hand. LED covers are provided at two sides of said LED light strip.

Preferably, a hinge fixing plate on said cabinet door is connected to a hinge mounting plate on said first separating plate via said hinge. Insulating pads are provided between said hinge on the one hand and said hinge fixing plate and said hinge mounting plate on the other hand.

Preferably, a bottom frame mirror is provided on said bottom plate between said first separating plate and said second separating plate.

Preferably, said division plate is a piece of tempered glass, and two ends of said piece of tempered glass are fixed to said first separating plate and said second separating plate via glass clamps.

Preferably, decorative rubber plugs are provided at two ends of said aluminium strip, said decorative strip and said hinge fixing plate.

Preferably, said upper frame, lower frame, left frame and right frame are of an aluminium alloy.

With the implementation of the present application, the beneficial effects are as follows.

The cabinet door makes use of the structure of a double-sided mirror door. An aluminium strip, a LED light strip and an anti-fog film are provided in the middle of the mirror door. The LED light strips and the anti-fog film on the cabinet door and the LED light strips on the cabinet body are electrically connected via a hinge connecting the cabinet door and the cabinet body. The anti-fog, film is an anti-fog film for a bathroom mirror, which can prevent the surface of the mirror from misting, thereby keeping the surface of the mirror clear. The cabinet body uses an aluminium alloy. The bottom face of the cabinet body is attached with a mirror. Light can penetrate from the side mirrors. The LED light strips in the cabinet are controlled by a sensory switch. The division plate in the middle of the cabinet body uses tempered glass and is fixed by glass clamps, thereby improving the stability and appearance. The overall structure is simple, has an aesthetic appearance and is convenient to use.

DETAILED DESCRIPTION OF THE INVENTION

In order to make the purpose and technical solutions of the present application clearer, the present application will be described below in further details with reference to the accompanying drawings.

Figure 1:
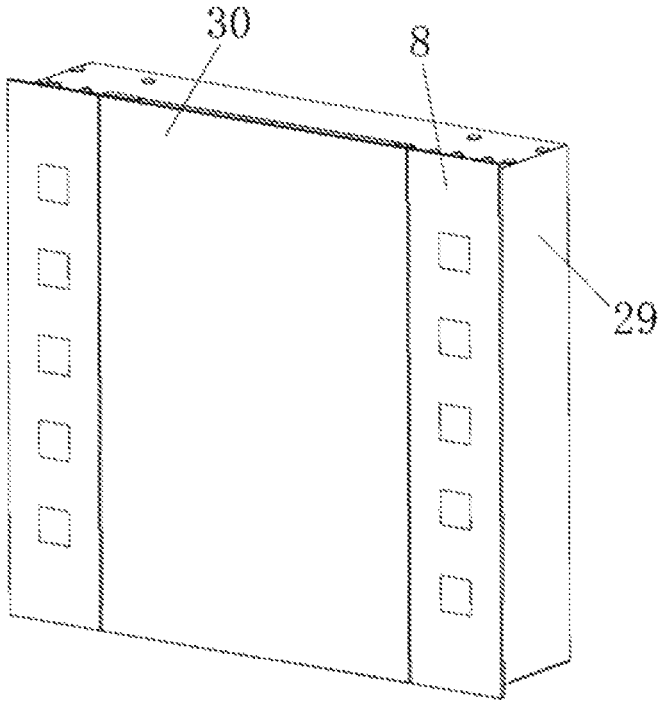
FIG. 1 is a schematic structural view of an embodiment of the present application.
Figure 2:
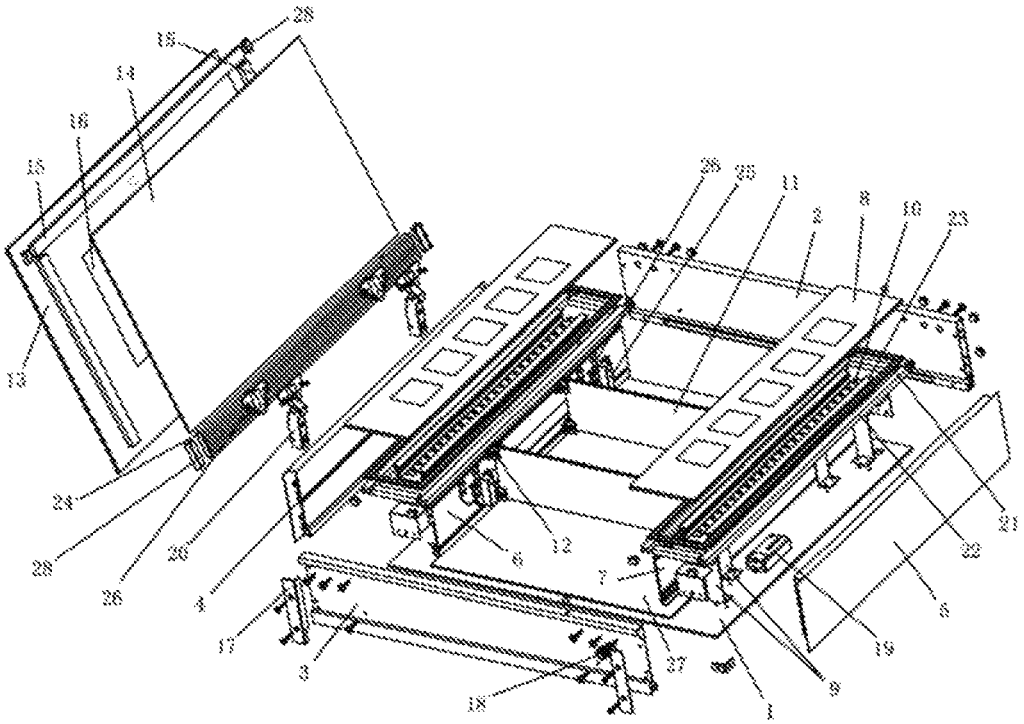
FIG. 2 is an exploded structural view of the embodiment of the present application.
Figure 3:
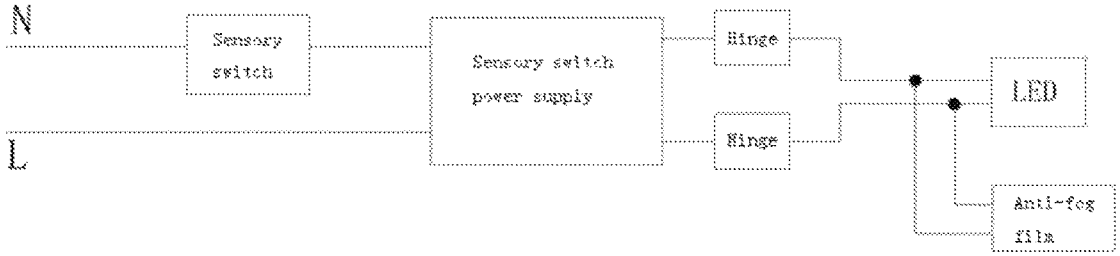
FIG. 3 is a schematic circuit diagram of the embodiment of the present application.

As shown in FIGS. 1-3, the present application provides a mirrored storage cabinet, including: a cabinet body 29 formed by a bottom plate 1 and aluminium alloy frames installed at four sides of the bottom plate 1; and a cabinet door 30 installed at an opening of the cabinet body 29. The aluminium alloy frames comprise an upper frame 2, a lower frame 3, a left frame 4 and a right frame 5. A first separating plate 6 and a second separating plate 7 are provided on the bottom plate 1 close to the left frame 4 and the right frame 5. Side mirrors 8 are provided respectively above the left frame 4 and the first separating plate 6 and above the right frame 5 and the second separating plate 7. LED light strips 10 are installed below the side mirrors 8 via supports 9 on the bottom plate 1. A division plate 11 of tempered glass is provided between the first separating plate 6 and the second separating plate 7. Two ends of the piece of tempered glass division plate 11 are fixed to the first separating plate 6 and the second separating plate 7 via glass clamps 12. A hinge fixing plate 24 on the cabinet door is connected to a hinge mounting plate 25 on the first separating plate 6 via a hinge 20, such that the cabinet door 30 is movably installed at the side edge of the first separating plate 6. Insulating pads 26 are provided between the hinge 20 on the one hand and the hinge fixing plate 24 and the hinge mounting plate 25 on the other hand. The hinge 20 is coated with an insulating rubber.

The cabinet door comprises a front door mirror 13 and a rear door mirror 14. An aluminium strip 15, a LED light strip and an anti-fog film 16 are provided between die front door mirror 13 and the rear door mirror 14.

Support legs 17 are installed at two sides of the bottom end of the lower frame 3 via countersunk head screws with cross recess. A sensor switch 18 is provided at the bottom end of the lower frame 3. The bottom plate 1 between the right frame 5 and the second separating plate 7 is provided with a sensory switch power supply 19. The sensory switch 18 is connected to an external power supply. The sensory switch 18 is connected to the LED light strip 10 and the anti-fog film 16 via the sensory switch power supply 19 and the hinge 20.

EVA adhesive 21 and decorative strips 22 are provided between the left and right frames and the first and second separating plates on the one hand and the side mirrors 8 on the other hand. LED covers 23 are provided at two sides of the LED light strip 10.

A bottom frame mirror 27 is provided on the bottom plate 1 between the first separating plate 6 and the second separating plate 7.

Decorative rubber plugs 28 are provided at two ends of the aluminium strip 15, the decorative strip 22 and the hinge fixing plate 24.

The cabinet door makes use of the structure of a double-sided mirror door. An aluminium strip, a LED light strip and an anti-fog film are provided in the middle of the mirror door. The LED light strips and the anti-fog film on the cabinet door and the LED light strips on the cabinet body are electrically connected via a hinge connecting the cabinet door and the cabinet body. The anti-fog film is an anti-fog film for a bathroom mirror, which can prevent the surface of the mirror from misting, thereby keeping the surface of the mirror clear. The cabinet body uses an aluminium alloy. The bottom face of the cabinet body is attached with a mirror. Light can penetrate from the side mirrors. The LED light strips in the cabinet are controlled by a sensory switch. The division plate in the middle of the cabinet body uses tempered glass and is fixed by glass clamps, thereby improving the stability and appearance. The overall structure is simple, has an aesthetic appearance and is convenient to use.

The above disclosure is only a preferred embodiment of the present application, and should not be used to limit the scope of protection of the present application, and therefore, equivalent changes made according to the claims of the present application still fall within the scope of protection of the present application.

I claim:

1. A mirrored storage cabinet, comprising:

a cabinet body formed by a bottom plate and an upper frame, a lower frame, a left frame and a right frame installed at four sides of said bottom plate; and a cabinet door installed at an opening of said cabinet body, the cabinet door being connected to the cabinet body via a hinge, wherein a first separating plate adjacent to said left frame, and a second separating plate adjacent to the right frame are provided on said bottom plate, a first side mirror is provided above said left frame and said first separating plate, and a second side mirror is provided above said right frame and said second separating plate, a plurality of first LED light strips are installed below said first side mirror and said second side mirror via a plurality of supports on said bottom plate, a division plate is provided between said first separating plate and said second separating plate, and said cabinet door is movably installed at a side edge of said first separating plate, said cabinet door comprises a front door mirror, a rear door mirror and an anti-fog film provided between said front door mirror and said rear door mirror, and a sensory switch is provided at said lower frame, a sensory switch power supply is provided within the cabinet body, and said sensory switch is connected to said first LED light strips and said anti-fog film via said sensory switch power supply and the hinge.

2. The mirrored storage cabinet according to claim 1, wherein said cabinet door further comprises a second LED light strip, and said sensory switch is connected to said second LED light strip via said sensory switch power supply and the hinge.

3. A mirrored storage cabinet, comprising:

a cabinet body formed by a bottom plate and an upper frame, a lower frame, a left frame and a right frame installed at four sides of said bottom plate; and a cabinet door installed at an opening of said cabinet body, wherein a first separating plate adjacent to said left frame, and a second separating plate adjacent to the right frame are provided on said bottom plate, a first side mirror is provided above said left frame and said first separating plate, and a second side mirror is provided above said right frame and said second separating plate, a plurality of first LED light strips are installed below said first side mirror and said second side mirror via a plurality of supports on said bottom plate, a division plate is provided between said first separating plate and said second separating plate, and said cabinet door is movably installed at a side edge of said first separating plate, wherein said cabinet door comprises a front door mirror and a rear door mirror, a second LED light strip and an anti-fog film are provided between said front door mirror and said rear door mirror, wherein support legs are provided at two edges of a bottom end of said lower frame, a sensory switch is provided at the bottom end of said lower frame, a sensory switch power supply is provided on said bottom plate between said right frame and said second separating plate, said sensory switch is connected to an external power supply, and said sensory switch is connected to said first LED light strips, said second LED light strip and said anti-fog film via said sensory switch power supply and a hinge.

4. The mirrored storage cabinet according to claim 3, wherein a first EVA adhesive and a first decorative strip are provided between said left frame and said first separating plate, said first EVA adhesive and said first decorative strip are provided under said first side mirror;

a second EVA adhesive and a second decorative strip are provided between said right frame and said second separating plate, said second EVA adhesive and said second decorative strip are provided under said second side mirror; and a plurality of LED covers are provided at two sides of each of said first LED light strips.

5. The mirrored storage cabinet according to claim 4, wherein a hinge fixing plate on said cabinet door is connected to a hinge mounting plate on said first separating plate via said hinge, and a plurality of insulating pads are provided between said hinge and said hinge fixing plate.

6. The mirrored storage cabinet according to claim 5, wherein a bottom frame mirror is provided on said bottom plate between said first separating plate and said second separating plate.

7. The mirrored storage cabinet according to claim 6, wherein said division plate is a piece of tempered glass, and two ends of said piece of tempered glass are fixed to said first separating plate and said second separating plate via a plurality of glass clamps.

8. The mirrored storage cabinet according to claim 7, wherein said cabinet door further comprises an aluminium strip, and a plurality of decorative rubber plugs are provided at two ends of each of said aluminium strip, said decorative strip and said hinge fixing plate.

9. The mirrored storage cabinet according to claim 8, wherein said upper frame, said lower frame, said left frame and said right frame are made of an aluminium alloy.

* * * * *